United States Patent [19]

Stupakis

[11] Patent Number: 4,958,586

[45] Date of Patent: Sep. 25, 1990

[54] FOLDING ANCHOR

[75] Inventor: John S. Stupakis, Orange, Calif.

[73] Assignee: JSS Scientific Corporation, Orange, Calif.

[21] Appl. No.: 266,801

[22] Filed: Nov. 3, 1988

[51] Int. Cl.[5] ..... B63B 21/44

[52] U.S. Cl. ..... 114/297; 114/303

[58] Field of Search ..... 114/294, 295, 296, 297, 114/298, 299, 300, 301, 302, 303, 304, 305, 306, 307, 308, 309, 310, 311

[56] References Cited

U.S. PATENT DOCUMENTS

| | | | |
|---|---|---|---|
| 103,205 | 5/1870 | Law . | |
| 2,720,184 | 10/1955 | Polenz | 114/208 |
| 2,905,128 | 9/1959 | Northrop | 114/207 |
| 3,215,111 | 11/1965 | McDaniel | 114/208 |
| 3,263,642 | 8/1966 | Wilson | 114/208 |
| 3,716,012 | 2/1973 | Wright | 114/207 |
| 3,793,977 | 2/1974 | Ziegler | 114/206 |
| 3,807,340 | 4/1974 | Diorio et al. | 114/208 |
| 3,822,666 | 7/1974 | Blomberg | 114/208 |
| 3,964,420 | 6/1976 | Stelling | 114/208 |
| 4,369,727 | 1/1983 | Fasco | 114/297 |
| 4,385,584 | 5/1983 | Simpson, III | 114/306 |
| 4,596,202 | 6/1986 | Brewster | 114/303 |
| 4,763,597 | 8/1988 | Stupakis | 114/297 |

*Primary Examiner*—Sherman Basinger

*Assistant Examiner*—Stephen P. Avila

*Attorney, Agent, or Firm*—Poms, Smith, Lande & Rose

[57] ABSTRACT

A folding anchor, having a shank formed in two pieces and pivotally joined together with a spring biased locking device. The fluke assemblies are pivotally connected via a coupling assembly at the lower end of the shank, the coupling assembly including first and second generally C-shaped retaining members for pivotal attachment of one fluke assembly to each, the first retaining member being secured to the lower shank, with the second retaining member pivotally connected to the first for pivoting about an axis generally perpendicular to the axis of pivoting of the flukes. the two retaining members are so formed, and joined, to permit pivoting of the fluke assemblies between folded and unfolded positions, whereby the two flukes may be rotated toward each other into proximate facing relation, or away from each other into alignment. Each fluke is generally triangular and pivotally attached to one of the retaining members to enable a limited amount of angular movement on a second axis orthogonal to the longitudinal axis of the shank relative to the flukes to facilitate engagement and disengagement relative to the sea bed. A trip member on the lower end of each fluke below the pivot axis thereof enables the tip of the fluke to more easily penetrate the sea bottom.

23 Claims, 2 Drawing Sheets

41a
21a
22a
26a
25
26b
27b
22
20
40
31a
30
31b
22b
29
22d
22c
21
3
51a
32
51c
33
51b
72
73
74
54
44
80
34
5
10
41b
41
31
41c
42
43
60
61c
81
85
87
86
88
82
31c
50
53

FOLDING ANCHOR

CROSS-REFERENCE TO RELATED APPLICATION

The subject matter of this application is related to the subject matter of applicant's patent application Ser. No. 07/040,023, entitled "Folding Anchor", filed by Applicant herein on Apr. 20, 1987, which issued on Aug. 16, 1988, as U.S. Pat. No. 4,763,597.

BACKGROUND OF THE INVENTION

The background of the invention will be discussed in two parts.

1. Field of the Invention

This invention relates to anchors, and more particularly to a folding anchor for small watercraft.

2. Description of the Prior Art

Anchors generally include a shank with a fluke arrangement at one end of the shank, the other end of the shank being connected to an anchor chain. Generally, the flukes are attached to the shank to permit a limited amount of angular movement. When the anchor is lowered into the sea, the flukes engage the sea bottom, with the shank extending at an angle to the sea bottom in a forward direction, that is, in the direction of the boat. For release of the anchor from engagement with the sea bottom, the boat direction is reversed to provide a direction of force thereon opposite to the direction of engagement of the flukes. To facilitate release, some anchors have been formed with two-piece shanks coupled for limited pivotal movement at a point intermediate the ends of the overall shank.

One such anchor is disclosed in U.S. Pat. No. 103,205, entitled "Anchor", such patent issuing on May 17, 1870 to Law. The anchor of this patent includes a two piece shank, with the upper shank piece being pivotable through a limited angle relative to the lower shank, to which is attached a fluke assembly, which is likewise pivotable through a limited angle.

Another anchor construction is shown and described in U.S Pat. No. 2,720,184, entitled "Articulated and Self-Locking Shank for Anchor", issued to Polenz on Oct. 11, 1955, such patent disclosing an anchor with a two-piece shank, the interconnection of the two pieces being by means of a keyhole slot engaged by a block member. In one position, the block is locked within the narrow neck of the slot with the two shank pieces in axial alignment. When force is exerted by the anchor chain in an opposite direction, the upper shank moves rearwardly relative to the lower shank until the block is in the enlarged portion of the keyhole, thereby permitting pivoting to facilitate release of the anchor from the sea bottom.

U.S. Pat. No. 2,905,128, entitled "Anchor", issued Sept. 22, 1959 to Northrop, and discloses an anchor having a removable guide, or stock member, which may be secured to the shank for storage or attached in perpendicular relation to a fluke retaining cross member.

Another example of an articulated anchor structure is disclosed in U.S. Pat. No. 3,263,642, entitled "Boat Anchor", which issued to Wilson on Aug. 2, 1966, the anchor including a unitary fluke formed of plate metal with first and second symmetrically arranged slots with a common origin. The shank is formed as a yoke with a bar engaging the slot at the origin, with the bolt able to traverse either slot to facilitate removal of the flukes from engagement with the sea bed.

Some anchors have been constructed to permit folding of the flutes and stock arms against the shank, such as shown in U.S. Pat. Nos. 3,215,111 and 3,807,340, the former being issued to McDaniel on Nov. 2, 1965, and the latter being issued to Diorio et al on Apr. 30, 1974. In both patents, the anchors are of the conventional Navy type and have the stock arms pivotally attached to the shank adjacent a first end thereof, with the flukes pivotally attached to the shank adjacent the other end thereof, with the plane of pivoting of the stock arms perpendicular to the plane of pivoting of the flukes. The Diorio anchor includes a spring member encircling the rod-shaped shank to spring load the stock arms to the open position.

An anchor including flukes which may be physically detached from the shank for storage is shown and described in U.S. Pat. No. 3,822,666, entitled "Anchor", which issued to Blomberg on July 9, 1974.

The last three patents enumerated above concern themselves with anchors of the folding type, with the Blomberg and McDaniel anchors being more suited for small pleasure craft usage. The flukes formed of plate metal, as shown in Blomberg, are of widespread use in small craft anchors of recent vintage. Although the Blomberg anchor permits detachment of the flukes for storage and transportation by removal and reattachment of bolts, the anchor should be reassembled prior to casting off, thereby eliminating any storage space advantage while at sea. On the other hand, while the McDaniel anchor permits folding to a relatively small overall configuration, the length of the folded anchor is the same as the length of the shank. Furthermore, such Navy anchors do not have widespread acceptance among small pleasure craft users.

Another anchor is shown and described in U.S. Pat. No. 3,716,012, entitled "Anchors for Marine Use", issued to Wright on Feb. 13, 1973, which discloses an anchor having a plowshaped head pivoted to the shank.

An anchor which includes spring loaded flukes is shown in U.S. Pat. No. 3,793,977, entitled "Vessel Anchor", which issued Ziegler on Feb. 26, 1974. The flukes are maintained against the shank against force of the spring bias by a ring member which is released on dropping the anchor by a telescoping tubular shank arrangement, expansion of which withdraws the ring member out of engagement with the flukes to permit pivoting under force of the springs.

An "Adjustable Anchor" shown and described in U.S. Pat. No. 3,964,420, issued to Stelling on June 22, 1976, the anchor including means for exchanging parts to form anchors of different configurations.

Another "Anchor" is shown and described in U.S. Pat. No. 4,369,727, issued to Fasco on Jan. 25, 1983, the anchor includes a fluke release mechanism actuated by an articulated shank mechanism which releases the fluke assembly to permit pivoting when the angle of the anchor chain is above a critical angle.

U.S. Pat. No. 4,385,584, entitled "Boat Anchor", issued to Simpson, III, on May 31, 1983, and discloses an anchor having removable fluke assemblies which enable compact storage of the anchor.

Another "Collapsible Boat Anchor" is shown and described in U.S. Pat. No. 4,596,202, which issued to Brewster on June 24, 1986, the anchor including a fixed grapple and a movable grapple.

In accordance with an aspect of the invention, it is accordingly an object of the invention to provide a new and improved foldable small craft anchor.

SUMMARY OF THE INVENTION

The foregoing and other objects of the invention are accomplished by providing a folding anchor, having a shank formed in two pieces and pivotally joined together with a spring biased locking device, and, upon pivoting the upper shank abuttingly overlies the lower shank. The fluke assemblies are pivotally connected via a coupling assembly at the lower end of the shank, the coupling assembly including a first generally C-shaped retaining member for pivotal attachment of one fluke assembly thereto, and a second generally identical C-shaped retaining member having the other fluke assembly pivotally coupled thereto. The first retaining member is secured to the lower shank, such as by welding, and the second retaining member is pivotally connected to the first for pivoting about an axis generally perpendicular to the axis of pivoting of the flukes. The two retaining members are so formed, that upon folding of the flukes toward one another, the ends of the short legs of the retaining members are in edge abutting relation. The configuration of the anchor enables pivoting of the fluke assemblies between folded and unfolded positions, this being accomplished by 90 degree pivoting of one fluke assembly relative to the other about a first axis generally parallel to the longitudinal axis of the shank, whereby the two flukes may be rotated toward each other into proximate facing relation, or away from each other into alignment. Each fluke is pivotally attached to one of the retaining members between the short arms thereof to enable a limited amount of angular movement on a second axis orthogonal to the longitudinal axis of the shank relative to the flukes to facilitate engagement and disengagement relative to the sea bed. The flukes are generally right triangularly configured and formed of plate metal. Each fluke is provided at the lower end with a "fishtail" trip member below the pivot axis thereof to enable the tip of the fluke to more easily penetrate the river, lake or ocean bed. The shank portions are formed of metal bar stock, and the balance of the anchor is formed from readily available metal stock assembled with conventional metal fabrication methods, such as welding, riveting and bending.

Other objects, features and advantages of the invention will become readily apparent from a reading of the specification, when taken in conjunction with the drawings, in which like reference numerals refer to like elements in the several views.

DESCRIPTION OF THE PREFERRED EMBODIMENT

Figures 1, 2, 5:
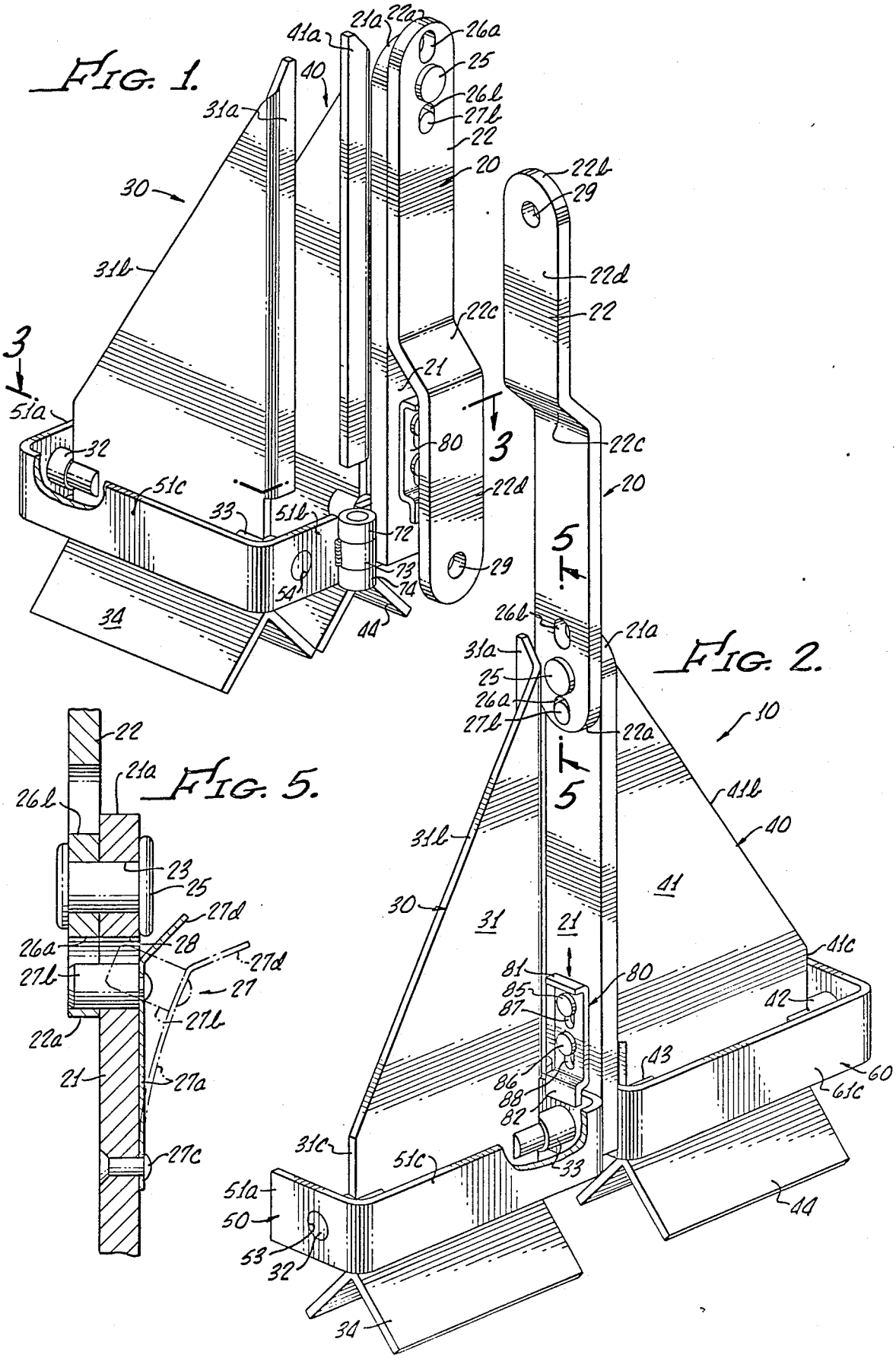
FIG. 1 is a perspective view of a foldable anchor according to the invention in its folded position.
FIG. 2 is a perspective view of the foldable anchor of FIG. 1, shown in its ready-for-use position.
FIG. 5 is an enlarged partial cross-sectional view of the upper and lower shank interconnection portion of the anchor of FIG. 1, illustrating the locking mechanism therefor.

Referring now to the drawings, and particularly to FIGS. 1 and 2, there is shown a preferred embodiment of an anchor, generally designated 10, in accordance with the invention, the anchor 10 including a shank assembly, generally designated 20, two fluke assemblies, generally designated 30 and 40, and first and second retaining assemblies, generally designated 50 and 60.

The shank assembly 20 is formed of first and second shank portions 21 and 22, each of which is formed of generally elongate metallic bar stock, and preferably double zinc coated for corrosion resistance. The shank portion 21 is the main, or lower shank portion, which is provided at one end **21*a* thereof with a circular pivot aperture 23 (See FIG. 5) on the longitudinal centerline thereof. Correspondingly, the lower end 22*a* (as viewed in FIGS. 2 and 5) of the upper shank 22 has an aperture 24 formed therein for receiving a fastener such as a button head rivet member 25, which is inserted through the aligned apertures 23 and 24 for pivotal coupling of the two shanks. In addition, the end 22*a* of upper shank 20 is provided with two like ovate holes 26*a* and 26*b* equally spaced on opposites sides of aperture 23, which holes are in position for engagement by a latch mechanism, generally designated 27. The upper end of shank 21 is likewise provided with a hole 28 at a position for alignment with either of the holes 26*a* and 26*b*. The size and spacing of the hole 28 relative to the apertures 26*a* and 26*b* is such that with the shanks 21 and 22 in axial alignment, the hole 28 will align with one of the two apertures, the aperture in alignment being determined by whether the shanks 21 and 22 are folded or extended. As shown in FIG. 5, the upper shank 22 is extended relative to shank 21, at which point, the hole 28 is in alignment with the aperture 26*a*. In FIG. 1, the shanks 21 and 22 are folded, and the hole 28 aligns with the other aperture 26*b***.

The latch mechanism 27 includes a leaf spring member **27*a*, supporting, adjacent one end thereof, a rod-shaped latch pin 27*b* having a diameter somewhat smaller than the diameter of the holes 26*a* and 26*b*. The other end of leaf spring member 27*a* is attached, such as by a rivet 27*c*, to the adjacent part of the lower shank 21. In this position, with the shanks 21 and 22 extended as shown in FIG. 5, the leaf spring 27*a* is in abutting relation with the adjacent surface of the lower shank 21, and the pin 27*b* in alignment within and engaging the aligned hole 28 and aperture 26*b*, to thus lock the two shanks together. The pin 27*b* is of a length sufficient to pass through both hole 28 and aperture 26*a*, that is, the length is generally equal to the combined thickness of the two shanks 21 and 22. The unrestrained end 27*d* of the leaf spring 27*a* is bent outwardly to enable gripping by a finger for urging the spring 27*a* against its bias to the position shown in broken lines in FIG. 5 for disengagement of the pin 27*b* a distance at least equal to the thickness of the shank 22**.

The upper end **22*b* of the shank 22 is provided with an offset portion defined by a bent transversely extending portion 22*c* adjoined with a straight section 22*d* lying in a plane generally parallel to but offset from the plane of the lower part of shank 22**. As shown in FIG.

1, this offset is to provide clearance for another latching or locking mechanism which will be described hereinafter. An anchor chain or line receiving opening 29 is formed in the distal end of the portion 22*d*.

Referring to FIGS. 1 and 2, the fluke assemblies 30 and 40 are generally identically dimensioned and are configured in mirror image relation, that is, a left and right assembly. However, the parts from which the two assemblies are fabricated are identical, and include flukes 31 and 41, which are formed of plate metal, preferable zinc-coated, with the main body portion being of a generally right triangular configuration including long side 31*a*, 41*a*, and hypotenuse 31*b*, 41*b*. A rectangular portion 31*c*, 41*c* depends from what would be the short side of the triangle, with first and second pivot pins 32, 33 and 42, 43 attached, such as by welding, to the opposite sides of the rectangular portions 31*c*, 41*c* with the pivot pins of each fluke assembly in axial alignment.

To provide rigidity, the edges of the long sides 31*a*, 41*a* of the flukes 31, 41 are bent at right angles to the plane of the main body portion of the flukes 31, 41. Attached, such as by welding, to the lower edges of the rectangular portions 31*c*, 411*c* of the flukes 31, 41 are trip members 34, 44 formed of angle iron or steel, with the attachment being at the corner of the right angle. Each leg of the trip member 34, 44 extends at a forty five degree angle to the plane of the main body portion of the fluke 31, 41 to which it is attached. With the anchor 10 in its ready for use position as shown in FIG. 2, the pivot pins 32, 33, 42, and 43 have the centers thereof in axial alignment, that is, on a common axis.

Figure 3:
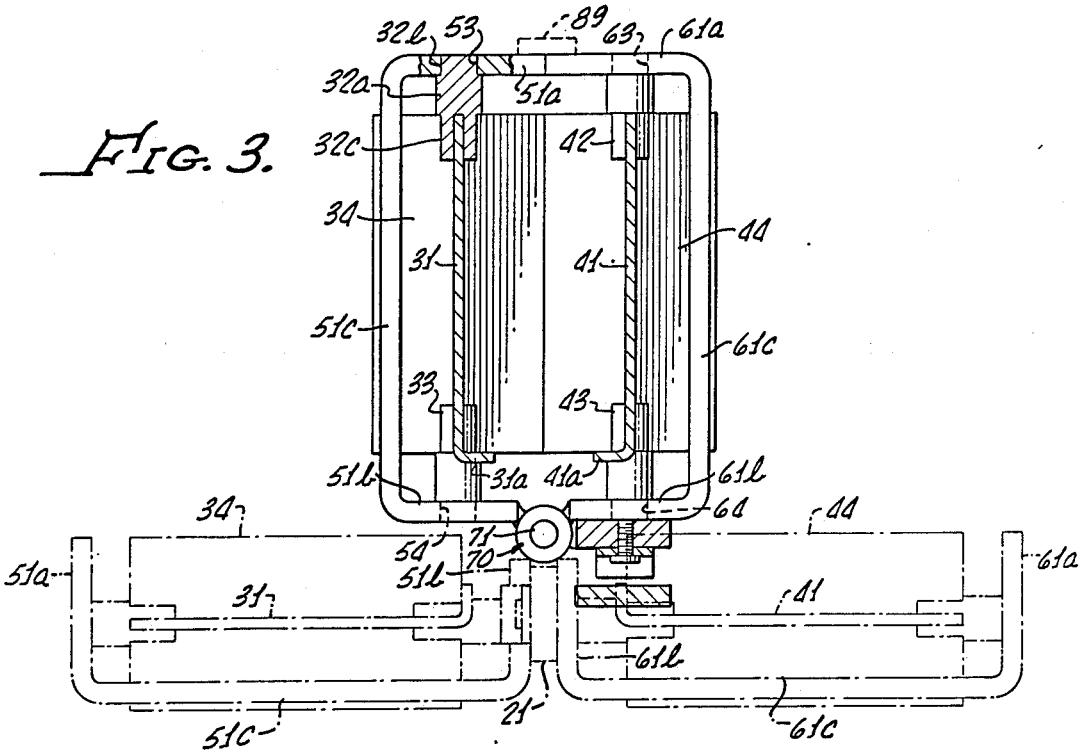
FIG. 3 is a cross-sectional top view of the anchor of FIG. 1 in its folded position as viewed generally along line 3—3 thereof, and depicting, in broken lines, the position of the fluke assemblies in the ready-for-use position.
Figure 4:
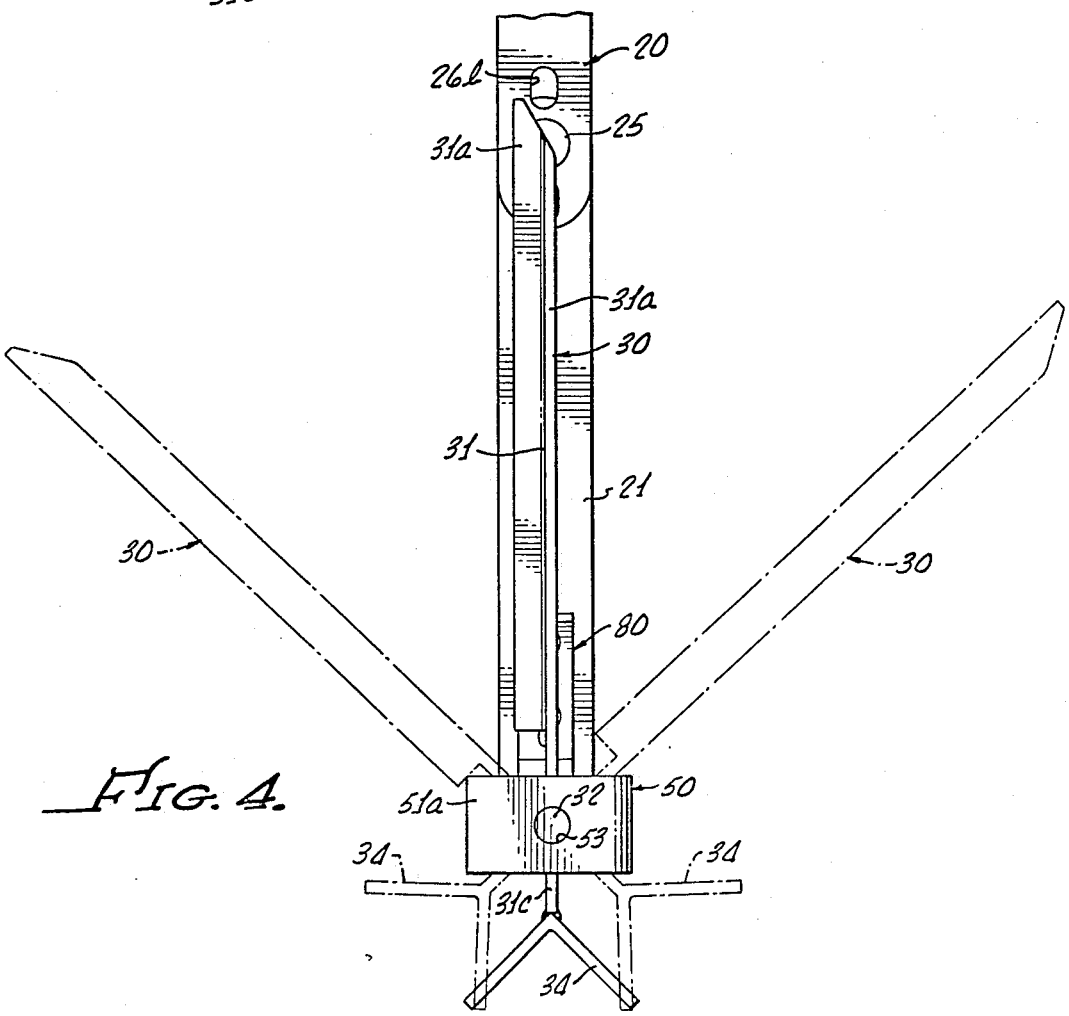
FIG. 4 is a side elevational view of the anchor of FIG. 1 in its ready-for-use position showing, in solid lines, the fluke position just prior to folding, and, in broken lines, the opposite extremes of angular pivoting of the fluke assembly.

Referring also to FIGS. 3 and 4, the coupling mechanism will now be described. The coupling assembly includes first and second fluke retaining assemblies 50 and 60. The retaining assembly 50 includes a first generally C-shaped retaining member 51 formed of bar stock bent into a C-shaped configuration with first and second oppositely disposed generally parallel short legs 51*a* and 51*b* and an interconnecting elongate bight portion 51*c*. The retaining assembly 60 includes a second generally identically configured C-shaped retaining member 61 formed of bar stock bent into a C-shaped configuration with first and second oppositely disposed generally parallel short legs 61*a* and 61*b* and an interconnecting elongate bight portion 61*c*.

Each of the retaining members 51, 61 is provided with bearing openings formed in the opposing short legs thereof with a line drawn between the centers of the two opendings being parallel to the plane of the bight portion thereof. For example, retaining member 51 is provided with aligned opposing bearing openings of apertures 53, 54 having a diameter sufficient for receiving the pivot pins 32, 33, respectively, therein. By reference to FIG. 3, each bearing or pivot pin 32, 33, 42, 43, is identically formed. For example, pivot pin 32, which is shown in cross-section has an enlarged diameter central portion 32*a*, with a first reduced diameter portion 32*b*, the diameter of which is sufficient for being pivotably received within bearing opening 53. The other reduced diameter portion 32*c* is slotted, with the slot dimension being slightly more than the thickness of the steel plate from which the fluke 31 is formed. With this arrangement, for assembly of the fluke 31 to the retaining member 51, the pivot pins 32, 33 may be inserted into the corresponding bearing openings 53, 54, whereupon the fluke 31 is inserted into the slots to the appropriate position, after which the fluke 31 may be welded to the pins 32, 33.

The width of the bar stock from which the retaining members 51 and 61 are formed is selected for enabling a given amount of angular pivoting of the fluke relative to the retaining member. For example, as shown in FIG. 4, the fluke 31 can pivot through an angle of plus or minus fifty degrees from normal, that is the total angular traverse is about 100 degrees. The angular movement clockwise, as viewed in the drawing, is limited by the fluke 31 abutting with the upper edge of the bight portion 51*c* of the retaining member 51. The angular movement in the opposite direction is limited by the lower edge of the rectangular portion 31*c* of the fluke 31 abutting against the lower edge of the bight portion 51*c* of the retaining member 51.

The retaining member 61 is generally identical and a complete description thereof is not necessary to a full understanding of the invetion. Briefly, by reference to FIG. 3, the bearing openings 63, 64 (in broken lines) receive the pivot pins 42, 43, respectively, of the fluke assembly 60, in the same manner as heretofore described. As with fluke 31, the fluke 41 can pivot through an angle of plus or minus fifty degrees from normal, with the angular movement in either direction from normal being limited by the fluke 41 abutting with the upper, or lower, edge of the bight portion 61*c* of the retaining member 61.

For connection of the fluke assemblies 30 and 40 for pivotal movement relative to one another, a hinge mechanism, generally designated 70, is provided. The hinge mechanism 70 is configured in the form of a strap hinge which includes a hinge pin 71 pivotally supporting first, second and third aligned adjacent hinge pin receiving portions 72–74 (See FIG. 1), the two outer ones 72 and 74 of which are secured to the edge of a short leg 61*b* of the retaining member 61, and the inner one 73 secured to the edge of the short leg 51*b* of the retaining member 61.

Referring also to FIG. 3, as can be seen, the dimensions of the hinge mechanism 70 are such that, with the portions 72–74 secured, such as by welding, to the ends of the short legs 61*b* and 51*b*, with the retaining members pivoted into the unfolded position as shown in broken lines, the elongate bight portions 51*c* and 61*c* of the retaining members 51 and 61, respectively, lie in the same plane. Additionally, in this position, the planes of the thus joined short legs 51*b* and 61*b* are parallel to one another, with a spacing therebetween, this spacing generally corresponding to the thickness of the lower end of the lower shank 21. This lower end of the lower shank 21 is welded to the surface of one of the short legs, in this case, short leg 61*b*. The welding is accomplished to provide a vertical orientation of the shank 21 as shown in FIG. 1, relative to a plane including the pivot axes of both flukes 31 and 41. The width of the lower end of lower shank 21 is such that it is less than the length of the short leg 61*b* to which it is attached. Also, as shown in FIG. 1, the length of the lower shank 21 is such that the upper edge lies in proximity to the uppermost part of the edges 31*a*, 41*a* of the flukes 31, 41. The length of the upper shank 22 is such that, in the folded position shown in FIG. 1, the edge 22*b* thereof extends to a position adjacent the hinge 70.

With the hinge mechanism 70, the retaining assemblies 50, 60, are pivotable relative to one another about the axis of the hinge pin 71, which axis lies along a line generally parallel to the main axis of the lower shank member 21. For locking the retaining members 51, 61 in the anchor unfolded position (broken lines in FIG. 3), a locking mechanism is provided, the mechanism including a sliding lock arm 80 (See FIG. 2), which is formed of a piece of strap metal having a first bent end 81 extending at a right angle to the plane of the metal, the end 81 being adapted for finger engagement for sliding of the arm 80. The other end 82 is shaped at an offset to provide a downwardly projecting finger which lies in a plane generally parallel to the plane of the main body portion of the arm 80. The offset spacing is generally equal to the thickness of the short arm **51*b* of the retaining member 61**.

The arm 80 is slidably attached to the outer surface of the lower part of the lower shank 21 by means of first and second button head rivets 85, 86 which are secured in aligned spaced relation to the lower end of shank 21 with the shafts thereof passing through aligned elongate slot openings 87, 88 formed within arm 80. The positioning and dimensioning of rivets 85, 86 and slots 87, 88 are such that with the lock arm 80 fully retracted upwardly (in the direction of the double ended arrow thereabove, the distal end of finger 82 lies above the edge of short arm **51*b*, and with the lock arm slid in the opposite direction, with the retaining members 51, 61 in the unfolded position, the inside of finger 82 is in surface abutting frictional contact with the short arm 51*b*, thus locking the retaining members 51, 61 in the position shown in FIG. 2 (and the broken line position shown in FIG. 3**).

Referring now to FIG. 3, the anchor 10 is shown in solid lines in plan view in the folded or storage position, and in broken lines in the unfolded, or ready for use, position. As shown, the dimensions of the parts enable compact folding for storage, and, in this position, the dimensions of the retaining members 51, 61 are such that the ends of the short arms **51*a*, 61*a* are in end abutting relation, with the elongate bight portions 51*c*, 61*c* in generally parallel relation. The dimensions of the trip members 34, 44 are such that in the folded position, the lower inner edges thereof are in edge contacting relation, thus placing the main plane of the flukes 31, 41 in generally parallel relation, with the overall plan configuration being a generally rectangular box-like configuration, to facilitate storage. Although not shown, another locking member may be readily placed on the outer surfaces of the abutting edges of the short arms 51*a*, 61*a*, in the area 89** indicated by dotted lines.

In the open position as shown in broken lines, and as shown in FIG. 2, the anchor 10 is ready for use with the upper shank 22 pivoted and latched relative to the lower shank 21, and with the retaining members 51, 61 pivoted to the unfolded position and latched via locking arm 80.

With the anchor 10 of the present invention, the first retaining member 61 is secured to the lower shank 21, such as by welding, and the second retaining member 51 is pivotally connected to the first for pivoting about a hinge pin 71 which defines an axis generally perpendicular to the axis of pivoting of the flukes 31, 41. The configuration of the anchor 10 enables pivoting of the fluke assemblies between folded and unfolded positions, this being accomplished by 90 degree pivoting of one fluke assembly retaining member 51 relative to the other about a first axis generally parallel to the longitudinal axis of the shank assembly 20, whereby the two flukes 31, 41 may be rotated toward each other into proximate facing relation, or away from each other into alignment. Each fluke 31, 41 is pivotally attached to one of the retaining members 51, 61 between the short arms thereof to enable a limited amount of angular movement on a second axis orthogonal to the longitudinal axis of the shank relative to the flukes to facilitate engagement and disengagement relative to the sea bed. With each fluke provided at the lower end with a "fishtail" trip member below the pivot axis thereof, ease of penetration, and removal of the pointed tips of the flukes 31, 41 from the river, lake or ocean bed are provided.

In accordance with the present invention, there has been shown and described an anchor 10, of economical fabrication of double zinc coated plate steel and bar steel to provide an effective anchoring means with the anchor 10 being capable of folding into a compact arrangement. While there has been shown and described a preferred embodiment, it is to be understood that various other adaptations and modifications may be made within the spirit and scope of the invention.

What is claimed is:

1. An anchor comprising:

first and second fluke retaining assemblies, each of said retaining assemblies including a generally identical generally C-shaped retaining member having first and second oppositely disposed generally parallel short legs and an interconnecting elongate bight portion;

hinge means secured to the distal ends of a short leg of each of said retaining members for enabling pivoting of said retaining members between a first folded position and a second unfolded position, said retaining members in said first position having the distal ends of the other short arms in edge abutting relation to define a generally rectangular opening, and said retaining members in said second position having the short legs with the hinge in generally parallel spaced relation;

shank means having a bar-shaped end of a thickness approximately equal to the spacing between adjacent short legs with said first and second retaining members pivoted to said first position;

means for attaching said end of said shank means in surface abutting relation to the exterior of a short leg for enabling said one end to be in surface abutting relation with the exterior of the adjacent short leg with said retaining members in said first position;

first and second fluke assemblies, each of said fluke assemblies being coupled for pivoting between the short legs of one of said retaining members for pivoting about an axis generally parallel to the elongate bight portion, with the pivot axis of one of said fluke assemblies being in axial alignment with the pivot axis of the other fluke assembly with said retaining members pivoted to said first position; and means for locking said retaining members in said first position.

2. The anchor according to claim 1 wherein said elongate bight portion of said retaining member is configured and positioned to limit the angle of pivoting of the attached fluke assembly.

3. The anchor according to claim 1 wherein said retaining member is formed of bar stock material and wherein the pivotal coupling of one of said fluke assemblies to said retaining member includes bearing apertures in the short arms of said retaining member coacting with pivot members on said fluke assembly.

4. The anchor according to claim 1 wherein each of said fluke assemblies include a generally planar, generally triangularly configured fluke member.

5. The anchor according to claim 4 wherein each of said fluke assemblies includes a trip member attached to an edge of said fluke member.

6. The anchor according to claim 5 wherein each of said fluke members includes a bent edge portion in proximate relation to said shank means.

7. The anchor according to claim 6 wherein said means includes two pivotally interconnected generally bar-shaped portions and means for locking said two members in generally aligned relation.

8. An anchor comprising:

shank means;

first and second fluke means;

first and second retaining means, each of said retaining means having opposing generally parallel short arm portions;

means for attaching one short arm portion of said first retaining means to one short arm portion of said second retaining means for enabling relative pivoting of said retaining means between first and second positions about a first axis, means for attaching each of said fluke means to one of said retaining means for pivoting between the short arms thereof about an axis generally perpendicular to said first axis, said retaining means being configured and dimensioned and attached so as to enable the pivot axes of said fluke means to be in axial alignment with said retaining means pivoted to said first position, and so as to enable the pivot axes of said fluke means to be in generally parallel relation with said retaining means pivoted to said second position;

means for attaching said shank means to one of said retaining means; and means for locking said retaining means in said first position.

9. The anchor according to claim 8 wherein each of said retaining means is generally identical, generally C-shaped and formed from a metal bar.

10. The anchor according to claim 8 wherein said shank means is attached to one of said retaining means with the longitudinal axis of said shank means extending on a line in the general direction of said first axis.

11. The anchor according to claim 8 wherein said means for attaching the short arm portions is a hinge means configured for maintaining the thus connected short arm portions in spaced parallel relation with said retaining means pivoted to said first position.

12. The anchor according to claim 11 wherein said shank means has an end having a thickness generally equal to the spacing between the thus connected short arm portions.

13. The anchor according to claim 12 wherein said shank means includes first and second pivotally interconnected portions and lock means for maintaining said first and second portions in generally aligned extended and folded relation.

14. The anchor according to claim 9 wherein the other short arm portions are dimensioned and configured for edge abutting relation with said retaining means in said second position forming a generally rectangular configuration with said fluke means in generally facing relation within the rectangle.

15. The anchor according to claim 14 wherin said fluke means includes generally planar, generally triangularly configured fluke members and trip members in fixed relation thereto.

16. The anchor according to claim 15 wherein said trip members are formed from metallic angle members secured at the outside corner thereof to an edge of said fluke member.

17. The anchor according to claim 16 wherein said fluke members and said trip members are dimensioned, configured and arranged for enabling said fluke members to be in generally parallel relation with said retaining means in said second position.

18. An anchor comprising:

first and second fluke assemblies;

first and second generally identically configured retaining means;

means for attaching said first fluke assembly to said first retaining means for enabling limited pivotal relative movement therebetween about a pivot axis;

means for attaching said second fluke assembly to said second retaining means for enabling limited pivotal relative movement therebetween about a pivot axis;

hinge means interconnecting said first and second retaining means for enabling selective pivoting of said first and second fluke assemblies between a first unfolded position with the pivot axes of said fluke assemblies in general axial alignment and a second folded position with said fluke assemblies in proximate facing relation; and means for securing said first and second retaining means in said first position, each of said retaining means being a generally C-shaped member having opposing short arm portions and an elongate bight portion.

19. The anchor according to claim 18 including shank means securely attached at one end thereof to a short arm portion of one of said retaining means, and wherein said securing means includes a lock member on said one end of said shank means for coacting selective engagement with the short arm portion of the other of said retaining means.

20. The anchor according to claim 18 wherein each of said fluke assemblies includes a generally plate-shaped fluke member and aligned pivot pins, and wherein said pivot pins are pivotally connected to said short arm portions with a line through said pivot pins being generally parallel to said bight portion.

21. The anchor according to claim 20 wherein each of said fluke assemblies include trip means, and wherein the majority of said fluke member is on one side of the pivot axis and said trip member is on the other side of the pivot axis.

22. An anchor comprising:

a shank, first and second flukes, first pivot means for interconnecting said flukes and said shank for pivotal motion of said flukes relative to each other about an axis parallel to said shank between a folded position wherein both flukes are adjacent each other and adjacent said shank and a partially folded position wherein said flukes extend laterally outwardly of said shank, and second pivot means for interconnecting said flukes and said shank for pivotal motion of said flukes relative to said shank about second and third axes transverse to said first axis between said partially folded position and an extended position in which said flukes extend substantially transversely of said shank.

23. The anchor of claim 22 wherein said first pivot means comprises first and second retainers pivotally connected to each other about said first axis, and wherein said second pivot means comprises means for pivotally connecting said first and second flukes to said first and second retainers, respectively for motion about said second and third axes.

* * * * *